US007341495B1

(12) United States Patent
Ulemek et al.

(10) Patent No.: US 7,341,495 B1
(45) Date of Patent: Mar. 11, 2008

(54) ELECTRICAL WEDGE CONNECTOR HEAT DISSIPATING DESIGN

(75) Inventors: Svetlana Ulemek, Bedford, NH (US); Michael Rzasa, Nashua, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/635,752

(22) Filed: Dec. 6, 2006

(51) Int. Cl.
*H01R 4/50* (2006.01)

(52) U.S. Cl. ..... 439/783; 439/863

(58) Field of Classification Search ..... 439/783, 439/863, 836
See application file for complete search history.

(56) References Cited

U.S. PATENT DOCUMENTS 3,065,449 A * 11/1962 Matthysse et al. ..... 439/783
3,280,856 A * 10/1966 Broske et al. ..... 140/113
3,588,791 A 6/1971 Polidori ..... 339/247
4,533,205 A * 8/1985 Frank ..... 439/783
5,244,422 A * 9/1993 Laricchia ..... 439/783
5,538,446 A 7/1996 Diniz et al. ..... 439/783
5,538,447 A 7/1996 Chadbourne et al. ..... 439/783
6,093,065 A 7/2000 Chadbourne ..... 439/783

* cited by examiner

*Primary Examiner*—James R. Harvey
*Assistant Examiner*—Travis Chambers
(74) *Attorney, Agent, or Firm*—Harrington & Smith, PC

(57) ABSTRACT

Disclosed herein is an electrical wedge connector wedge. The electrical wedge connector wedge includes a first conductor contact surface, a second conductor contact surface, and a center section. The second conductor contact surface is opposite the first conductor contact surface. The center section is between the first conductor contact surface and the second conductor contact surface. The center section has a first lateral side and a second lateral side. The first lateral side includes a first undulating surface. The second lateral side is opposite the first lateral side. The second lateral side includes a second undulating surface.

20 Claims, 6 Drawing Sheets

ELECTRICAL WEDGE CONNECTOR HEAT DISSIPATING DESIGN

BACKGROUND OF THE INVENTION

1. Field of the Invention

The present invention relates to an electrical connector and, more particularly, to an electrical wedge connector.

2. Brief Description of Prior Developments

Electrical wedge connectors for connecting electrical conductors to each other are well known in the art. Electrical wedge connectors generally comprise a C-shaped shell (or sleeve) and a wedge. U.S. Pat. Nos. 6,093,065 and 5,538,447 disclose electrical wedge connectors having various shell and wedge configurations. Electrical wedge connectors, such as the WEJTAP™ connector system sold by FCI USA, Inc., for example, are designed to provide reliable connections in power distribution networks. In order to ensure long term reliability, these connections are subjected to extensive tests simulating the most severe service and weather conditions. Additionally, these connections may be required to meet or exceed industry standards such as ANSI (American National Standards Institute) C119.4 Class 3 and NEMA (National Electrical Manufacturer's Association) CC3 1973 Class A 500 Heat cycles, for example. As electric utility operating environments become more severe and demanding, there is a need to improve the heat transfer and weight characteristics of the electrical connections in order to comply with the aforementioned tests and standards.

Accordingly, there is a need for light weight, increased heat dissipation electrical wedge connector wedge providing improved durability.

SUMMARY OF THE INVENTION

In accordance with one aspect of the present invention, an electrical wedge connector wedge is disclosed. The electrical wedge connector wedge includes a first conductor contact surface, a second conductor contact surface, and a center section. The second conductor contact surface is opposite the first conductor contact surface. The center section is between the first conductor contact surface and the second conductor contact surface. The center section has a first lateral side and a second lateral side. The first lateral side includes a first undulating surface. The second lateral side is opposite the first lateral side. The second lateral side includes a second undulating surface.

In accordance with another aspect of the present invention, an electrical wedge connector wedge is disclosed. The electrical wedge connector wedge includes a first end, a second end, a first conductor contact surface, a second conductor contact surface, and a center section. The second end is opposite the first end. The first conductor contact surface is between the first end and the second end. The second conductor contact surface is between the first end and the second end. The second conductor contact surface is opposite the first conductor contact surface. The center section is between the first conductor contact surface and the second conductor contact surface. The center section includes an elongated thru hole extending from a first lateral side of the center section to a second lateral side of the center section. A length of the elongated hole is oriented substantially perpendicular to the first end and the second end.

In accordance with another aspect of the present invention, an electrical wedge connector wedge is disclosed. The electrical wedge connector wedge includes a first end, a second end, a first conductor contact surface, a second conductor contact surface, a first lateral side, and a second lateral side. The second end is opposite the first end. The first conductor contact surface is between the first end and the second end. The second conductor contact surface is between the first end and the second end. The second conductor contact surface is opposite the first conductor contact surface. The first lateral side is between the first conductor contact surface and the second conductor contact surface. The first lateral side is configured to face a closed side of a mating sleeve. The second lateral side is between the first conductor contact surface and the second conductor contact surface. The second lateral side is opposite the first lateral side. The second lateral side is configured to face an open side of the mating sleeve. The second lateral side includes a plurality of grooves. The plurality of grooves extend from the first end to the second end.

In accordance with yet another aspect of the present invention, an electrical wedge connector is disclosed. The electrical wedge connector includes a sleeve and a wedge. The wedge is insertable into the sleeve. The wedge includes a first end and a second end. A first conductor contact surface extends from the first end to the second end. A second conductor contact surface, opposite the first conductor contact surface, extends from the first end to the second end. A first lateral side of the wedge includes at least two generally concave recesses extending along a majority of a length between the first end and the second end. A second lateral side of the wedge, opposite the first lateral side, includes at least two generally concave recesses extending along a majority of the length between the first end and the second end.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
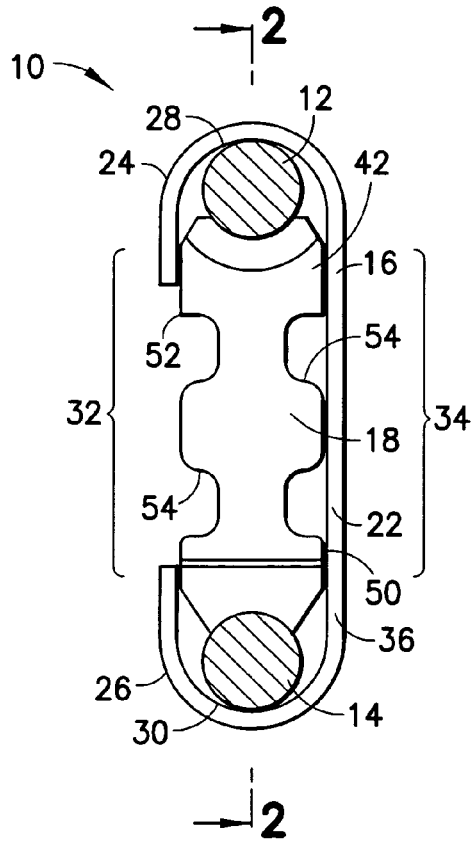
FIG. 1 is a rear elevational view of an electrical wedge connector.

Referring to FIG. 1, there is shown an end view of an electrical wedge connector 10 incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

Figure 2:
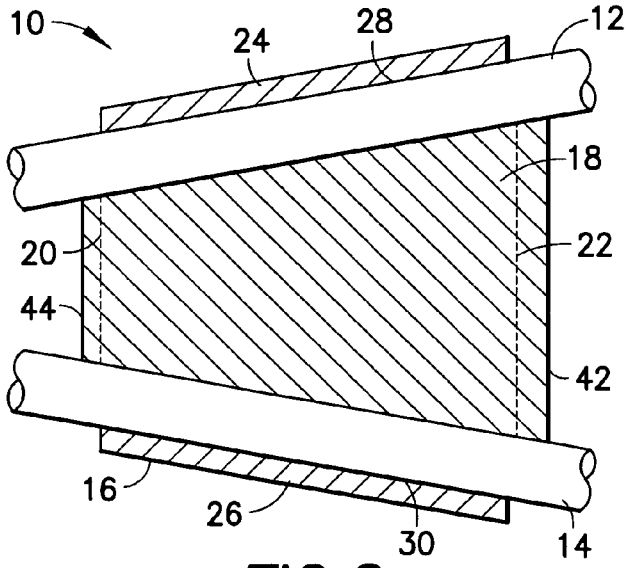
FIG. 2 is a cross section view of the electrical wedge connector shown in FIG. 1 taken along line 2-2.

As shown in FIGS. 1 and 2, the electrical wedge connector 10 mechanically and electrically connects two electrical conductors 12, 14 to each other. The electrical wedge connector 10 generally comprises a shell or sleeve 16 and a wedge 18. The sleeve 16 is preferably comprised of a one-piece member made of electrically conductive material, such as metal for example. The sleeve 16 has a general C-shaped cross section and a general wedge shape between its front end 20 and its rear end 22. The sleeve 16 has two opposing channel sections 24, 26 with interior surfaces 28, 30 that form conductor contact surfaces. The sleeve 16 has an open side 32 and a closed side 34. The closed side 34 comprises a center section 36 interconnecting the two opposing channel sections 24, 26. Various different wedge connector shells or sleeves are known in the art and may be used in practicing the present invention. Thus, in alternate embodiments, any suitable type of wedge connector shell or sleeve may be used.

Figure 3:
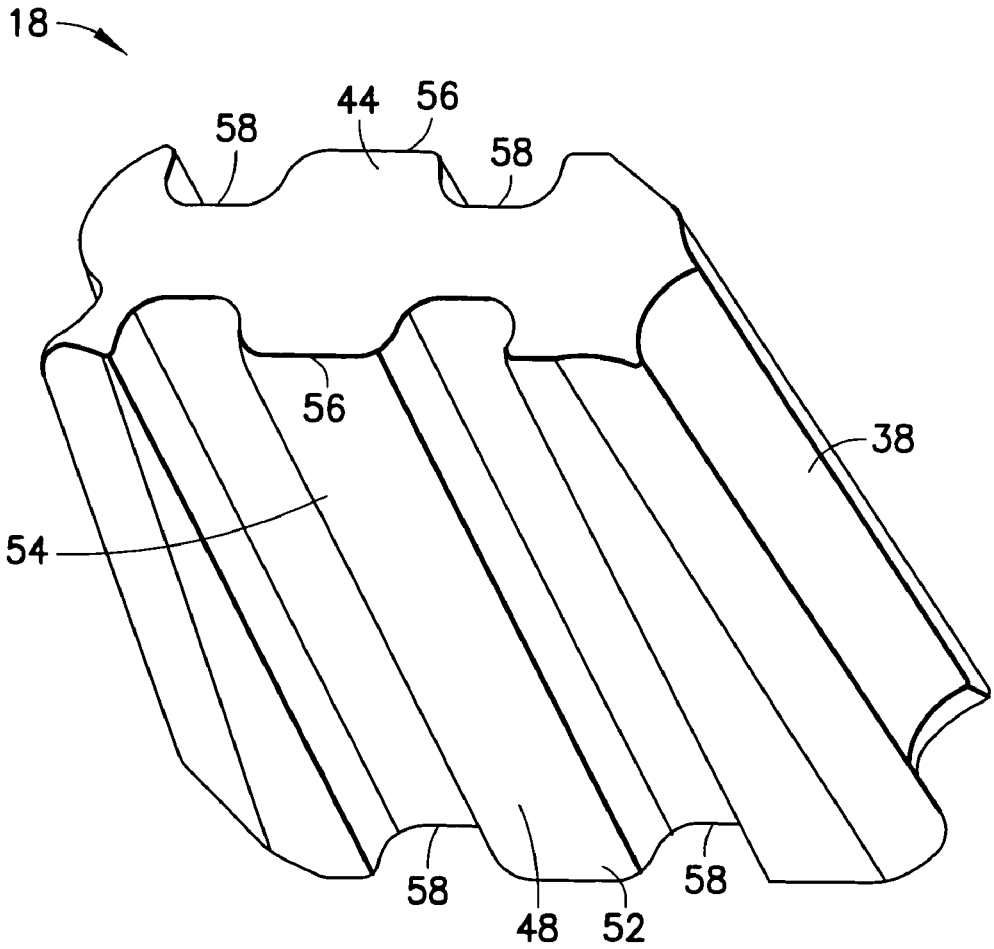
FIG. 3 is a perspective view of an electrical wedge connector wedge used in the electrical wedge connector shown in FIG. 1.
Figure 4:
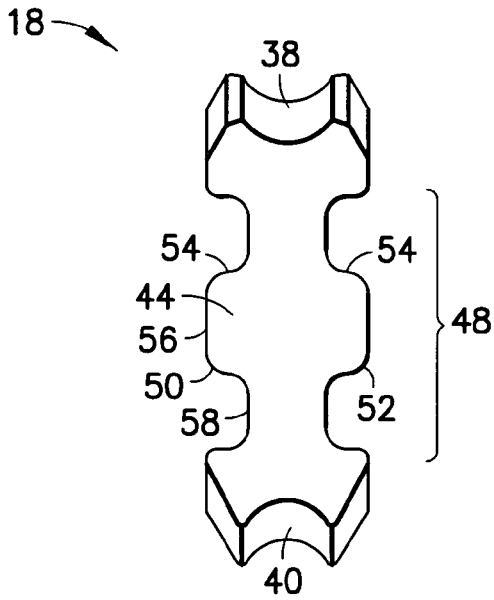
FIG. 4 is a front elevational view of the electrical wedge connector wedge shown in FIG. 3.
Figure 5:
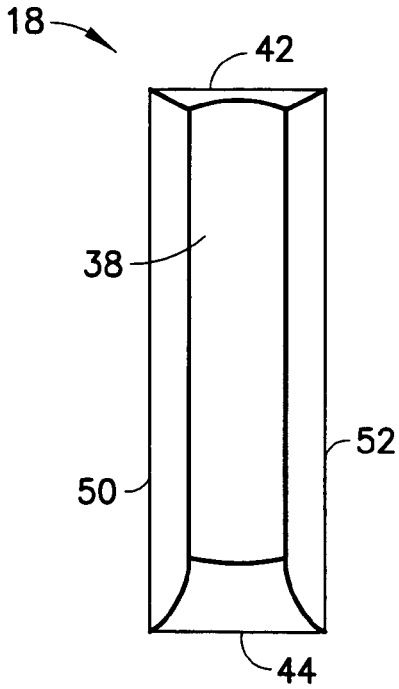
FIG. 5 is a top plan view of the electrical wedge connector wedge shown in FIG. 3.
Figure 6:
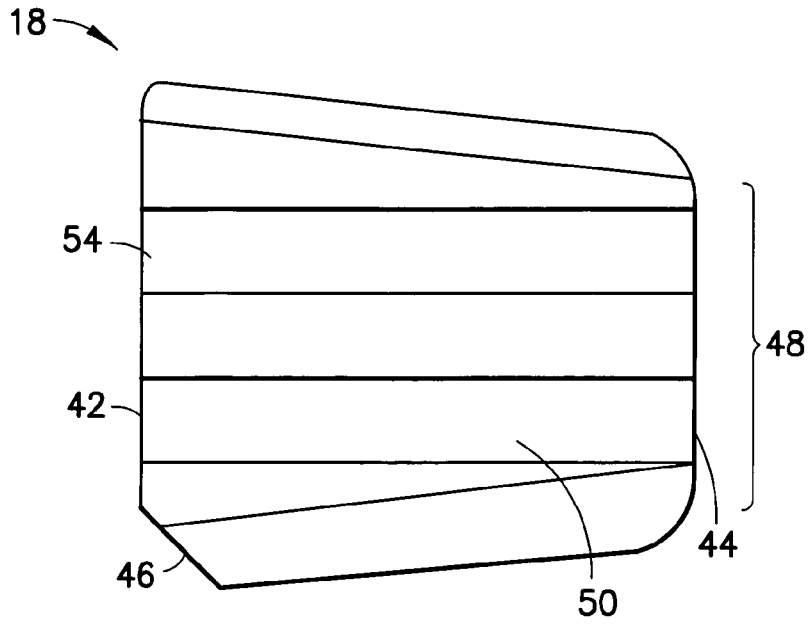
FIG. 6 is a right side elevational view of the electrical wedge connector wedge shown in FIG. 3.
Figure 7:
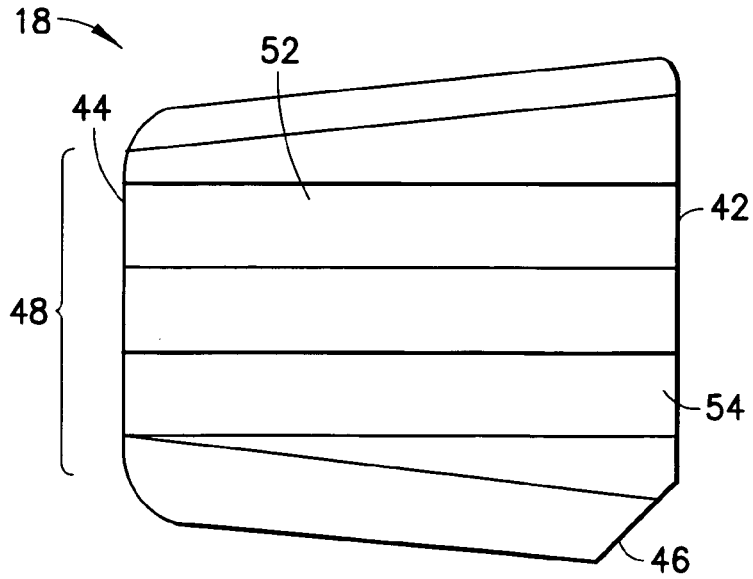
FIG. 7 is a left side elevational view of the electrical wedge connector wedge shown in FIG. 3.
Figure 8:
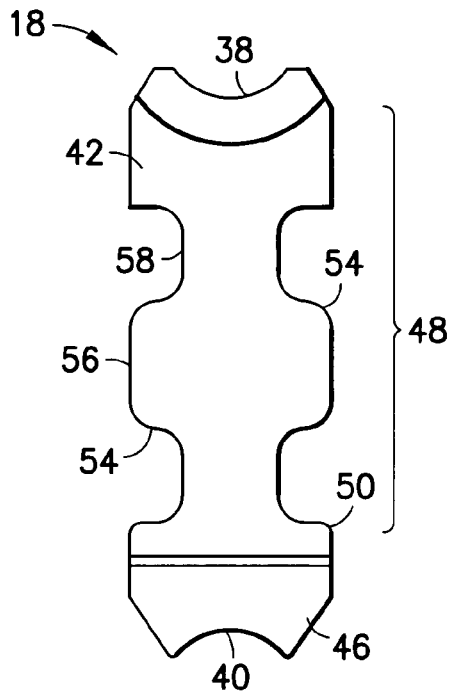
FIG. 8 is a rear elevational view of the electrical wedge connector wedge shown in FIG. 3.
Figure 9:
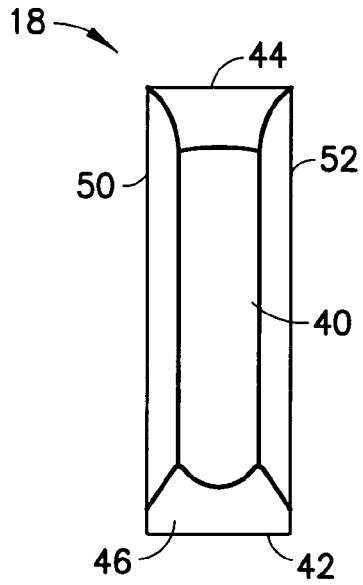
FIG. 9 is a bottom plan view of the electrical wedge connector wedge shown in FIG. 3.

Referring now to FIG. 3, there is shown a perspective view of the wedge 18 in accordance with a first embodiment of the present invention. The wedge 18 is adapted to wedge the two electrical conductors 12, 14 against the respective opposing interior surfaces 28, 30 of the channel sections 24, 26. The wedge 18 comprises features providing for an improved wedge configuration having increased surface area and reduced weight. The wedge 18 exhibits improved efficiency with a higher degree of heat transfer over conventional configurations.

The wedge 18, further illustrated in FIGS. 4-9, preferably comprises a one-piece member made of a suitable material, such as cast or extruded metal, for example. In an alternate embodiment, the wedge 18 could be comprised of more than one member. The wedge 18 comprises a first conductor contact surface 38 and an opposing second conductor contact surface 40. The first conductor contact surface 38 and the second conductor contact surface 40 extend from a first end 42 to a second end 44 of the wedge 18. The first conductor contact surface 38 and the second conductor contact surface 40 each may have a general groove or concave shape. It should be understood that although the figures illustrate the conductor contact surfaces 38, 40 as having a general groove or concave shape, any suitable shape for contacting a conductor 12, 14 is envisioned. As illustrated in the figures, the contact surfaces 38, 40 and the ends 42, 44 may intersect at chamfered or blended edges. Although the figures show a chamfered edge 46 between the first end 42 and the second conductor contact surface 40, and blended edges elsewhere, it is to be understood that any combination of chamfered or blended edges may be provided.

The wedge 18 has a general wedge shaped profile between the first end 42 and the second end 44. The conductor contact surfaces 38, 40 taper (or are angled) toward a center section 48 of the wedge 18 from the first end 42 to the second end 44. The center section 48 is between the first conductor contact surface 38 and the second conductor contact surface 40. The center section 48 comprises a first lateral side 50 and a second lateral side 52. Each of the lateral sides 50, 52 has an undulating, or wavy, surface 54. The undulating surfaces 54 add surface area to the lateral sides 50, 52 of the wedge 18. The increased surface area provides for better heat dissipation and improved overall reliability over conventional configurations.

Each of the undulating surfaces 54 comprises a generally convex portion 56 between two generally concave recesses (or grooves) 58. The generally convex portion 56 and the generally concave recesses 58 extend from the first end 42 of the wedge 18 to the second end 44 of the wedge 18. The generally convex portion 56 and the generally concave recesses 58 are substantially perpendicular to the first end 42 and the second end 44 of the wedge 18.

It should be understood that the generally convex portion 56 and the generally concave recesses 58 need not extend along an entire length between the first end 42 and the second end 44 of the wedge 18. Instead, the generally convex portion 56 and the generally concave recesses 58 may extend along a majority of a length between the first end 42 and the second end 44 of the wedge 18. Additionally, the concave recesses 58 and the convex portions 56 may extend from only one of the ends 42, 44 or neither end 42, 44 at all. Furthermore, it should be understood that the concave recesses 58 and the convex portions 56 need not be substantially perpendicular to the ends 42, 44 and may extend in any direction. It should also be understood that although the figures illustrate two concave recesses 58 and one convex portion 56 per lateral side 50, 52, any number of concave recesses 58 and convex portions 56 may be provided. The wedge 18 provides a means for dissipating heat wherein the generally convex portions 56 and the generally concave recesses 58 are oriented to maximize surface areas of the lateral sides 50, 52.

The undulating surfaces 54 on the first lateral side 50 and the second lateral side 52 are substantially similar to each other. When the wedge 18 is installed in the C-shaped sleeve 16, one of the lateral sides 50, 52 is configured to face the closed side 34 of the mating C-shaped sleeve 16. The other of the lateral sides 50, 52 is configured to face the open side 32 of the C-shaped sleeve 16. Additionally, the concave recesses 58 on the first lateral side 50 may be aligned with the concave recesses 58 on the second lateral side 52. The convex portions 56 on the first lateral side 50 and the second lateral 52 side may also be aligned with one another.

To attach the electrical wedge connector 10 to the conductors 12, 14, the first conductor 12 is inserted into the channel sections 24. The second conductor 14 is inserted into the channel section 26. The wedge 18 is inserted into the sleeve 16 between the conductors 12, 14. The wedge 18 may be power wedged into the sleeve 16 by any suitable tool in order to fixedly capture the first conductor 12 and the second conductor 14. The first conductor 12 is fixedly captured between the interior surface 28 of the channel section 24 and the first conductor contact surface 38 of the wedge 18. The second conductor 14 is fixedly captured between the interior surface 30 of the channel section 26 and second conductor contact surface 40 of the wedge 18. The first side 50 of the wedge 18 is adjacent to the closed side 34 of the sleeve 16. The second side 52 of the wedge 18 is adjacent to the open side 32 of the sleeve 16.

It should be understood that although the figures illustrate the wedge 18 contacting substantially equally sized conductors 12, 14, the wedge 18 may be configured to accommodate different sized conductors. Additionally, it should be noted that although the figures illustrate the wedge 18 as contacting two conductors 12, 14, wedge configurations contacting only one conductor or more than two conductors are envisioned.

The disclosed wedge 18 provides for a wedge configuration having reduced weight and increased surface area. The disclosed wedge 18 will improve the efficiency of the electrical wedge connector 10 and have a higher degree of heat transfer over conventional configurations.

Figure 10:
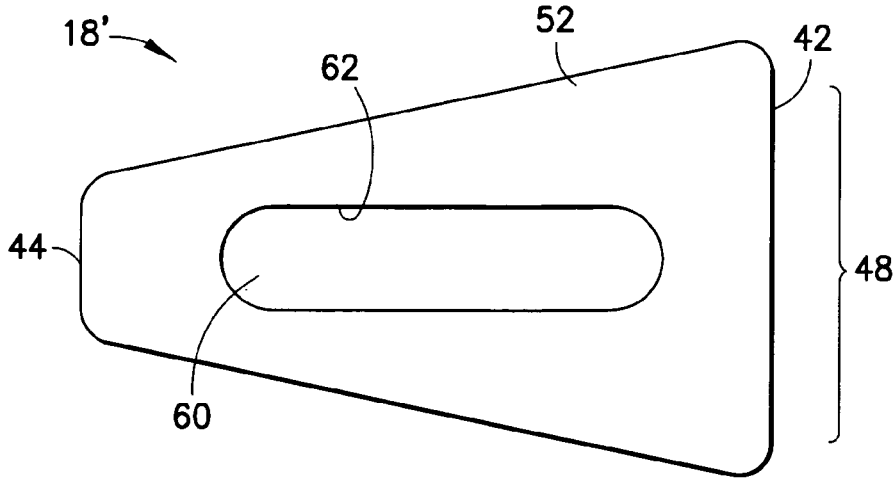
FIG. 10 is a left side elevational view of an alternative electrical wedge connector wedge used in the electrical wedge connector shown in FIG. 1.
Figure 11:
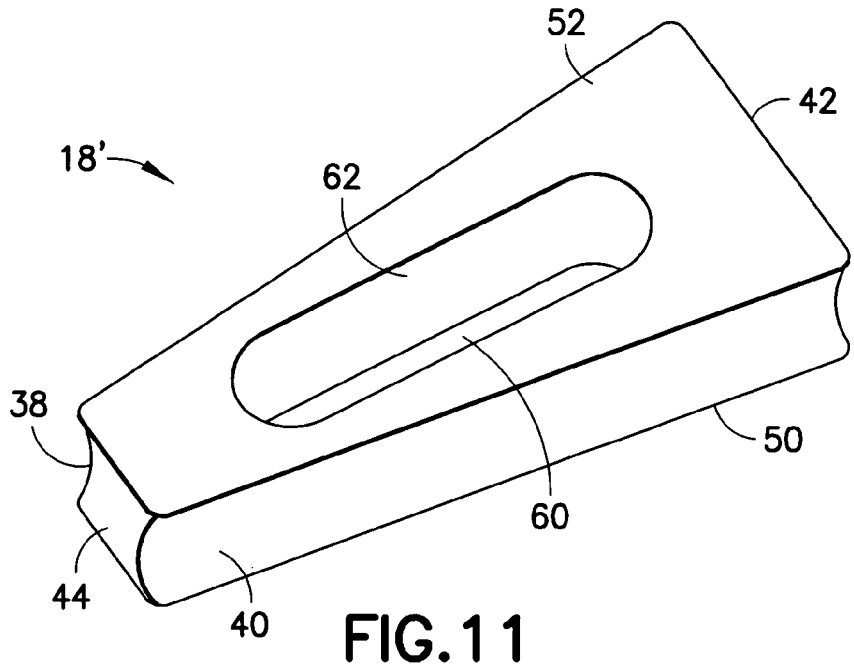
FIG. 11 is a perspective view of the alternative electrical wedge connector wedge used in the electrical wedge connector shown in FIG. 1.

Referring now to FIGS. 10-11, there is shown a top plan view and a perspective view, respectively, of a wedge 18' in accordance with a second embodiment of the present invention. The wedge 18' is similar to the wedge 18 and similar features are similarly numbered.

The wedge 18' has a general wedge shaped profile and conductor contacting surfaces 38, 40 extending from a first end 42 to a second end 44 as described above for the first embodiment. One difference between the wedge 18' and wedge 18 is that the wedge 18' does not comprise undulating surfaces 54. Instead, the wedge 18' comprises an elongated thru hole 60 extending from a first lateral side 50 of the center section 48 to a second lateral side 52 of the center section 48. The elongated thru hole 60 provides a similar improvement to the wedge configuration as the undulating surfaces 54 in that the elongated thru hole 60 also comprises means for dissipating heat. The means for dissipating heat for the wedge 18' comprises the elongated through hole 60 being disposed to maximize a surface area of the wedge 18'. The surface area is maximized by the additional exposed inner wall 62 of the elongated thru hole 60.

The elongated thru hole 60 is disposed such that a longer dimension of the elongated hole 60 extends along a majority of a length between the first end 42 and the second end 44 of the wedge 18'. The length of the elongated hole 60 may be oriented substantially perpendicular to the first end 42 and the second end 44 of the wedge 18' as illustrated in FIGS. 10-11. Additionally, the first conductor contact surface 38 and the second conductor contact surface 40 may be oriented at an acute angle with respect to the length of the elongated hole 60. It should be understood that although FIGS. 10-11 illustrate the length of the elongated hole 60 as extending along the majority of the length of the wedge 18', an elongated hole 60 of any length may be provided. Additionally, it should be noted that an elongated hole 60 oriented at an angle with respect to the ends 42, 44 of the wedge 18' is also envisioned. Furthermore, although FIGS. 10-11 illustrate a single elongated hole 60, more than one elongated hole may be provided.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector wedge comprising:

a first conductor contact surface;

a second conductor contact surface opposite the first conductor contact surface; and a center section between the first conductor contact surface and the second conductor contact surface, wherein a first lateral side of the center section comprises a first undulating surface, and wherein a second lateral side of the center section, opposite the first lateral side, comprises a second undulating surface, wherein at least one of the undulating surfaces comprises a plurality of concave recesses, wherein each of the concave recesses extend along a majority of a length of the center section between front and rear ends of the wedge.

2. The electrical wedge connector wedge of claim 1 wherein the first undulating surface and the second undulating surface each comprise at least two generally concave recesses.

3. The electrical wedge connector wedge of claim 2 wherein the first undulating surface and the second undulating surface each comprise at least one generally convex portion between each of the at least two generally concave recesses.

4. The electrical wedge connector wedge of claim 2, wherein the conductor contact surfaces taper between the front and rear ends, and wherein the at least two generally concave recesses extend substantially perpendicular from the front end to the rear end.

5. An electrical wedge connector comprising a sleeve and an electrical wedge connector wedge as in claim 1, wherein the electrical wedge connector wedge is insertable into the sleeve.

6. An electrical wedge connector wedge comprising:

a first end;

a second end opposite the first end;

a first conductor contact surface between the first end and the second end;

a second conductor contact surface between the first end and the second end, wherein the second conductor contact surface is opposite the first conductor contact surface; and a center section between the first conductor contact surface and the second conductor contact surface, wherein the center section comprises an elongated thru hole extending from a first lateral side of the center section to a second lateral side of the center section, and wherein a front to rear elongate length of the elongated hole is oriented substantially perpendicular to the first end and the second end.

7. The electrical wedge connector wedge of claim 1 wherein the elongated thru hole extends along a majority of a length between the first end and the second end.

8. The electrical wedge connector wedge of claim 1 wherein the electrical wedge connector wedge comprises means for dissipating heat wherein the means for dissipating heat comprises the elongated through hole being disposed to maximize a surface area of the electrical wedge connector wedge.

9. The electrical wedge connector wedge of claim 1 wherein the first conductor contact surface and the second conductor contact surface are oriented at an acute angle with respect to the length of the elongated hole.

10. An electrical wedge connector comprising a sleeve and an electrical wedge connector wedge as in claim 6, wherein the wedge is insertable into the sleeve.

11. An electrical wedge connector wedge comprising:

a first end;

a second end opposite the first end;

a first conductor contact surface between the first end and the second end;

a second conductor contact surface between the first end and the second end, wherein the second conductor contact surface is opposite the first conductor contact surface;

a first lateral side between the first conductor contact surface and the second conductor contact surface, wherein the first lateral side is configured to face a closed side of a mating sleeve; and a second lateral side between the first conductor contact surface and the second conductor contact surface, wherein the second lateral side is opposite the first lateral side, wherein the second lateral side is configured to face an open side of the mating sleeve, wherein the second lateral side comprises a plurality of grooves, and wherein at least one of the grooves extend from the first end to the second end.

12. The electrical wedge connector wedge of claim 11 wherein the first conductor contact surface and the second conductor contact surface are angled relative to each other.

13. The electrical wedge connector wedge of claim 11 wherein the first lateral side further comprises a plurality of grooves, and wherein the plurality of grooves extend from the first end to the second end.

14. The electrical wedge connector wedge of claim 11 wherein the second conductor contact surface intersects the first end at a chamfered edge.

15. An electrical wedge connector comprising a sleeve and an electrical wedge connector wedge as in claim 11, wherein the wedge is insertable into the sleeve.

16. An electrical wedge connector comprising:

a sleeve; and a wedge insertable into the sleeve, wherein the wedge comprises a first end and a second end, wherein a first conductor contact surface extends from the first end to the second end, wherein a second conductor contact surface, opposite the first conductor contact surface, extends from the first end to the second end, wherein a first lateral side of the wedge comprises at least two generally concave recesses each extending along a majority of a length between the first end and the second end, and wherein a second lateral side of the wedge, opposite the first lateral side, comprises at least two generally concave recesses each extending along a majority of the length between the first end and the second end.

17. The electrical wedge connector of claim 16 wherein the at least two generally concave recesses of the first lateral side are aligned with the at least two generally concave recesses of the second lateral side.

18. The electrical wedge connector of claim 16 further comprising at least one generally convex portion between the at least two generally concave recesses of the first lateral side and at least one generally convex portion between the at least two generally concave recesses of the second lateral side.

19. The electrical wedge connector of claim 18 wherein the wedge comprises means for dissipating heat wherein the means for dissipating heat comprises the generally concave recesses and the generally convex portions being oriented to maximize surface areas of the lateral sides.

20. The electrical wedge connector of claim 18 wherein the at least one generally convex portion of the first lateral side is aligned with the at least one generally convex portion of the second lateral side.

* * * * *